US005555987A

United States Patent [19]

Yoshimura et al.

[11] Patent Number: 5,555,987

[45] Date of Patent: Sep. 17, 1996

[54] SITE-ASSEMBLED FOLDING SHELF

[76] Inventors: Sabro Yoshimura, c/o Naigai Co., Ltd. 16, 39-banchi, Fukakusa Mukaigawara-cho, Fushimi-ku, Kyoto, Kyoto, Japan; Hiroshi Yamamoto, 2-30-7 Kuboyama-cho, Hachioji-shi, Tokyo, Japan

[21] Appl. No.: 269,054

[22] Filed: Jun. 29, 1994

[30] Foreign Application Priority Data

Jun. 30, 1993 [JP] Japan ..... 5-183468

[51] Int. Cl.[6] ..... A47F 5/00

[52] U.S. Cl. ..... 211/153; 211/182; 211/201

[58] Field of Search ..... 211/153, 195, 211/182, 149, 201; 108/115, 162

[56] References Cited

U.S. PATENT DOCUMENTS

| | | | |
|---|---|---|---|
| 1,765,651 | 6/1930 | Bryant | 211/182 X |
| 2,599,670 | 6/1952 | Thomas | 211/149 X |
| 2,962,170 | 11/1960 | Best | 211/182 |
| 3,462,021 | 8/1969 | Hawke et al. | 211/153 X |
| 4,045,104 | 8/1977 | Peterson | 211/182 X |
| 4,346,540 | 8/1982 | Anderson | 211/182 X |
| 4,862,602 | 9/1989 | Krill | 211/182 X |

*Primary Examiner*—Robert W. Gibson, Jr.
*Attorney, Agent, or Firm*—Fish & Richardson P.C.

[57] ABSTRACT

A site-assembled folding shelf for displaying marchandise comprises a plurality of square pipe members and a plurality of pipe joints equipped with pipe anchor pins for each fastening a square pipe member thereon by fitting the square pipe thereon and rotating it by 45° and configured to enable depth-direction square pipe members to be swung relative to lateral square pipe members for folding the shelf.

5 Claims, 3 Drawing Sheets

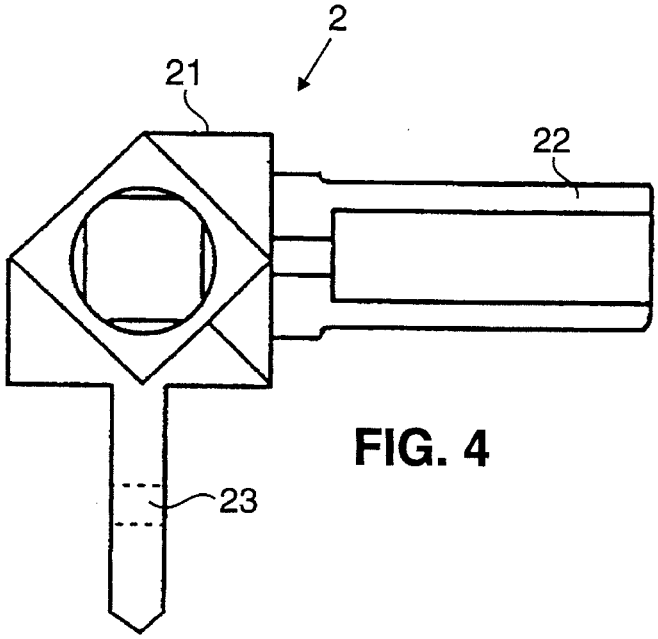
FIG. 4
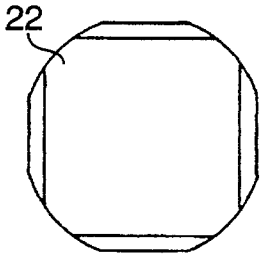
FIG. 5
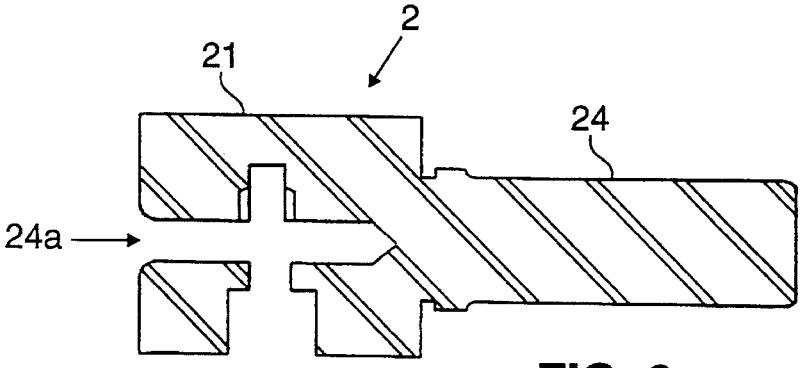
FIG. 6
FIG. 7
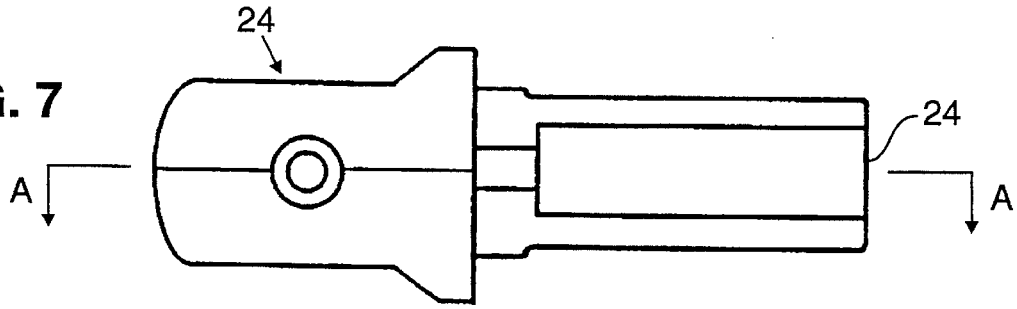

SITE-ASSEMBLED FOLDING SHELF

BACKGROUND OF THE INVENTION

1. Field of the Invention

This invention relates to a site-assembled shelf for displaying merchandise, more particularly to such a site-assembled shelf which is assembled by fitting component square pipe members onto pipe joints and then rotating and fastening the square pipes, and still more particularly to such a site-assembled shelf configured so that the whole shelf can be folded by horizontally rotating anchor pins of the pipe joints.

2. Prior Art Statement

Some of the various types of prior art merchandise display shelves are designed to be foldable so as to facilitate transport and storage or to save space when the shelf is not needed. Merchandise display shelves and show cases generally have to be set up or changed within short periods on a day when the store or shop is closed. Because of this, knock-down shelves that can be easily assembled at the site are used in large numbers. Such shelves are easy to transport and can be conveniently assembled at the site. In addition, they can be set up in a configuration matched to the size and shape of the shop.

The prior art site-assembled shelves are, however, disdvantageous in that the assembly work is time consuming and requires the use of experienced workers. Moreover, when a prior art site-assembled shelf becomes unnecessary owing to changes in the shop layout, a method has to be found for storing it and an appropriate amount of storage space must be secured.

Although the amount of time and labor required at the site can be reduced by delivering preassembled shelves, assembled shelves are troublesome to transport and handle. In addition, they take up a large amount of space and lower the utilization efficiency of the truck or the like used to haul them. Although a shelf configured to be foldable has been developed to overcome this problem, the conventional folding shelf can only be assemble in a standard size and shape. The impossiblity of modifying the shelf configuration means that special shelves have to be ordered in light of the shape and height restrictions imposed by the shop where the installation is to be made. In addition, while knock-in type site-assembled shelves are available, not only do they fail to provide relief from the troublesome assembly work, they also create another problem: the knocked together components cannot be reused owing to deformation occuring during knock-in. Moreover, the complex movements they permit make it necessary to use numerous types of pipe joints, which detracts from the working efficiency.

Site-assembled merchandise display shelves that are made of pipe members come in two types. In one type the pipe members are assembled by using a hammer or the like to pound them onto tapered anchor pin members with an outside diameter approximately equal to the inside diameter of the pipe members. The other type, which is designed for simple assembly, uses square pipe members and the anchor pins of the pipe joints are fit into the square pipe members as offset by 45°, whereafter a tool is used to rotate the pipe members by 45° so as to bring the coupling surfaces of the two members against each other.

SUMMARY OF THE INVENTION

One object of this invention is to provide a site-assembled shelf suitable for displaying merchandise, which advantageously utilizes rotation-fixed pipe joints that can be easily attached and detached.

Another object of the invention is to provide a site-assembled shelf that can be assembled in various ways to match the height, width and other conditions of the installation site and which can be angularly adjusted in line with the shape of the installation site.

Another object of the invention is to provide a site-assembled folding shelf which can be folded for transport or storage.

For achieving these objects, this invention provides a site-assembled folding shelf suitable for displaying merchandise and configured by assembling pipe members and pipe joints, the shelf comprising:

a plurality of square pipes members and a plurality of pipe joints equipped with pipe anchor pins for each fastening a square pipe member thereon by fitting the square pipe member thereon and rotating it by 45° and configured to enable a square pipe member lying in the depth-direction of the shelf to be swung relative to a square pipe member lying in the lateral direction of the shelf.

In a preferred aspect, the invention further provides such a site-assembled folding shelf wherein each pipe joint comprises:

a base and a plurality of pipe anchor pins formed integrally with the base to meet at right angles at the base, each pipe anchor pin being formed as a column of octagonal section with coupling surfaces for contacting inner walls of a square pipe member and thereby tightly fastening the square pipe member when the square pipe member is fitted thereon and rotated by 45° and one or more pipe anchor pins comprising a support member extending integrally from the base to enable the pipe anchor pin to rotate and a rotating member rotatably joined with the support member.

The site-assembled folding shelf according to this invention is assembled by fitting the ends of the plurality of square pipe members of approximately the same inside diameter onto pipe coupling members (the pipe joints) as offset by 45° with respect thereto and then using a tool (spanner, wrench or the like) to grasp and rotate the square pipe members by 45° to thereby bring the coupling surfaces of the anchor pins into contact with the inner walls of the pipe member and thus tightly attached the pipe members and the pipe joints. The number of pipe joint anchor pins mutually intersecting at right angles at the base of the joint member differs according to the shelf configuration. The pipe joints used at the four corners of the three-dimensional shelf frame have three anchor pins while a pipe joint located at the center of vertically and laterally interconnected shelves has six anchor pins.

One or more of the anchor pins of each pipe joint used in this invention is rotatable so as to enable the pipe members lying in the depth direction of the shelf to rotate relative to the lateral pipe members and thus allow the rectangular shelf to collapse into a parallelogram and then fold up entirely in the lateral direction. Instead of rotating the depth-direction square pipe members, it is also possible to make the vertical or lateral pipe members rotatable.

BRIEF DESCRIPTION OF THE DRAWINGS

FIG. 4 is a plan view of a pipe joint used at a position marked B in FIG. 1.

FIG. 5 is an end view of a pipe joint anchor pin.

FIG. 6 is a side view of a pipe joint rotating member.

FIG. 7 is a plan view of the rotating member.

DESCRIPTION OF THE PREFERRED EMBODIMENT

Figure 1:
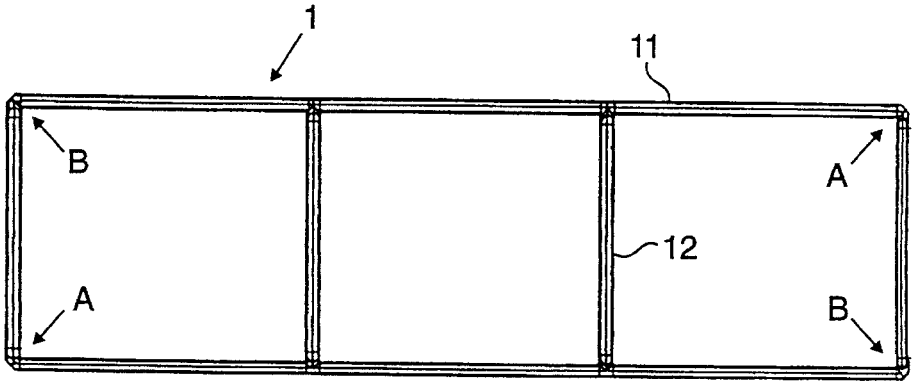
Fig. 1 is a plan view of a site-assembled folding shelf according to the invention.
Figure 2:
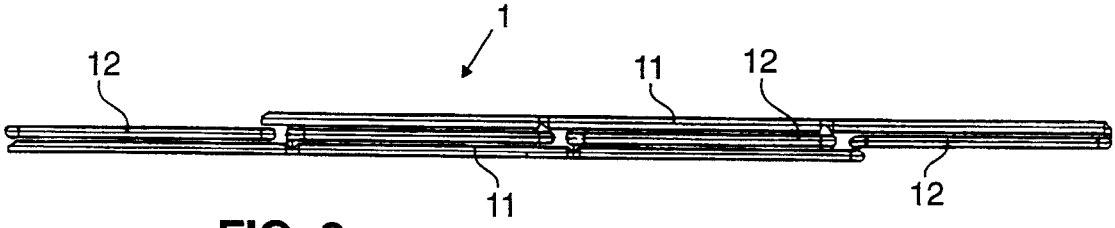
FIG. 2 is a plan view of the shelf of FIG. 1 as folded.

An embodiment of the site-assembled folding shelf according to the invention will now be explained with reference to the drawings. FIG. 1 is a plan view of a site-assembled folding shelf 1 according to the invention set up for use as a merchandise display shelf, and FIG. 2 is a plan view of the shelf folded for storage or transport.

Figure 9:
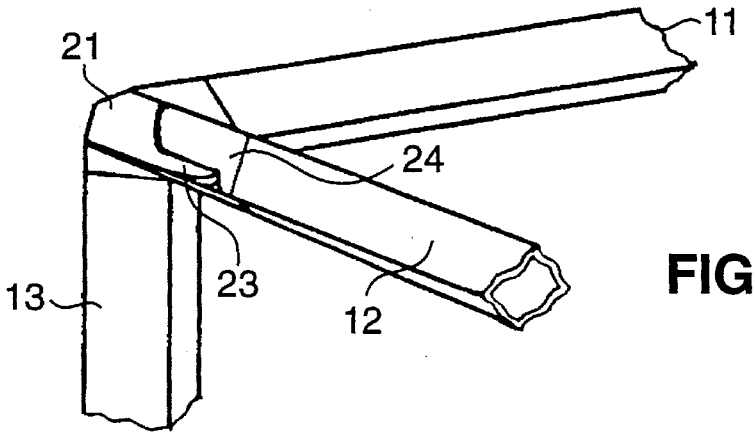
FIG. 9 is a perspective view of a shelf corner.

The site-assembled folding shelf 1 is a three-dimentional frame constituted by lateral pipe members 11, depth-direction pipe members 12 and vertical pipe members 13 (see Fig. 9). One or more shelf boards are placed horizontally on the frame for supporting merchandise to be displayed. The folding shelf according to the invention is assembled using pipe joints having pipe anchor pins that allow square pipe members to rotate (swing). Specifically, the configuration is such that each depth-direction pipe member 12 is able to rotate 180° relative to the associated lateral pipe member 11. As a result, the shelf can be folded as shown in FIG. 2. Moreover, the configuration is such that after a square pipe member is fitted onto a pipe anchor pin, the pipe member can be rotated 45 ° to bring the coupling surfaces of the anchor pin and the inner walls of the square pipe member into tight surface contact, thus securely coupling the square pipe member and the anchor pin.

Figure 3:
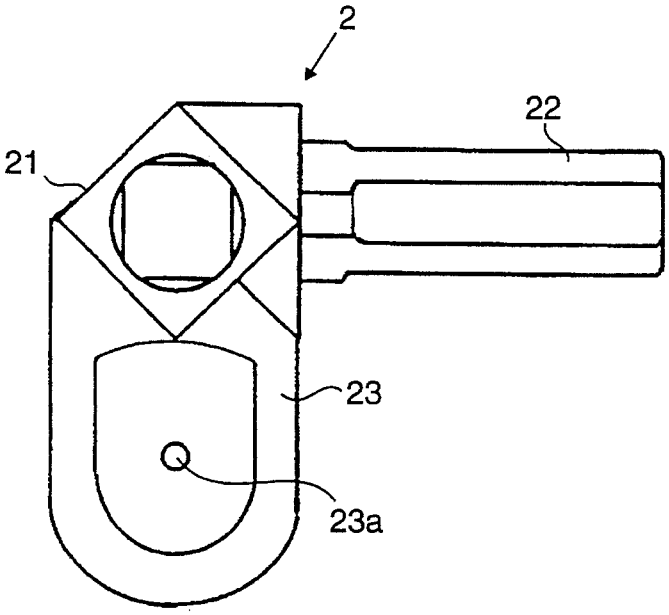
FIG. 3 is a plan view of a pipe joint used at a position marked A in FIG. 1.

The structure of a pipe joint is shown in FIG. 3. The pipe joint, indicated by reference numeral 2, comprises a base 21 and a plurality of pipe anchor pins 22 (only one shown). As shown in FIGS. 3 to 8, the pipe joint of the invention is constituted such that some or all of the anchor pins are rotatable. A plurality of pin anchor pins 22 extend perpendicular to the base 21 and consequently intersect at right angles at the base 21. The anchor pins 22 are disposed so as to maintain their mutually perpendicular relationship. The number of projecting anchor pins 22 is not specifically defined. When shelves are joined vertically or laterally, the respective corners require pipe joints with different numbers of anchor pins. Up to six anchor pins 22, one projecting from each surface of the base 21, can be provided integrally with the base 21. The base 21 is configured as a cube displaced 45 ° relative to the anchor pins 22.

The anchor pins 22 are integrally formed of the same metal material as the base 21. As can be seen from the end view of an anchor pin 22 shown in FIG. 5, each anchor pin 22 is a column of generally octagonal section capable of establishing tight surface contact with a pipe member. FIGS. 3 and 4 show pipe joints 2 having differently configured support members 23. In FIG. 3, the support member 23 extends horizontally and has a horizontally extending rotating memeber 24 fitted therein. In FIG. 4, on the other hand, the support member 23 extends vertically and the rotating member 24 is also attached to extend vertically. The difference is merely one deriving from different directions of rotation. The pipe joint of FIG. 3 is used at the positions marked A in FIG. 1 and that of FIG. 4 is used at the positions marked B.

Figure 8:
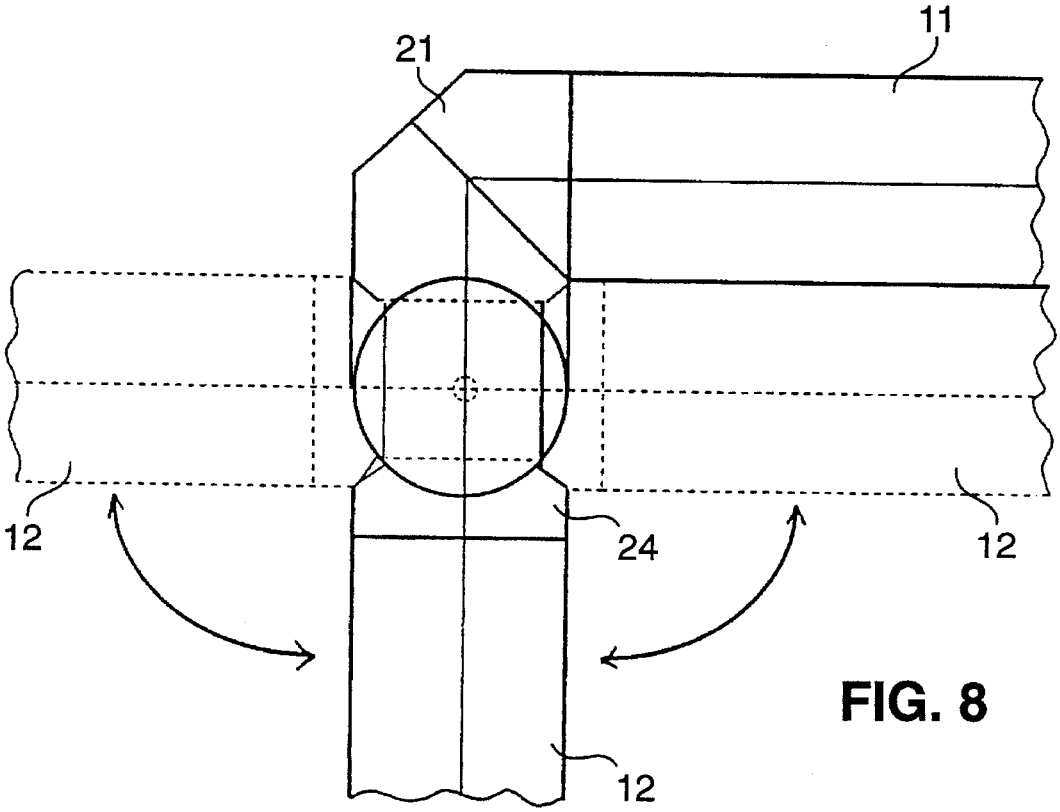
FIG. 8 is a plan view showing how a pipe member is rotated.

As shown in FIGS. 6 to 8, the rotating anchor pin comprises the support member 23 and the rotating member 24. As shown in FIGS. 3 and 4, the support member 23 is formed to project from the base 21 with which it is integrally formed and is slightly thicker than a support member retaining slot 24*a* shown in FIG. 6. A screw hole 23*a* rotatably retaining the rotating member 24 is formed at the center of the support member 23. Like the anchor pins 22, the rotating member 24 is also configured as a column of generally octagonal section. It is fitted on a support member via a retaining slot at its proximal end is rotatably engaged with the supporting member by a screw 24*b*.

Owing to its configuration as described in the foregoing the site-assembled folding shelf according to this invention has the following advantageous features:

1) The shelf can be easily assembled due to the fact that the joints and pipe joints can be rotated using a simple tool and that the insertion of the joints into the square pipe members is simpler than in the case of the prior art knock-in system. Moreover, once used pipe members and joints can be reused after disassembly.

2) Since the number of component types is small, ordering of required components is easy and inventories can be kept low.

3) While the prior art folding shelf requires that numerous types of pipe joints be brought to the site in advance and be carefully selected to avoid mistakes, the folding shelf according to the invention requires only a few types of pipe joints that do not have to be selected with reference to direction during assembly.

4) The folding shelf can be provided in a shape and size matched to the shop layout and, moreover, can be installed in a shop that zigzags or whose walls do not meet at right angles.

5) Since the pipe joints are rotatable over a certain range, the shelf can be easily folded without disassembly when it is to be transported or has become unnecessary.

What is claimed is:

1. A site-assembled folding shelf suitable for displaying merchandise and configured by assembling pipe members and pipe joints, comprising:

a plurality of pipe members having a substantially square interior cross-section;

a plurality of pipe joints having pipe anchor pins, each anchor pin adapted to engage the interior cross-section of one pipe member when the pipe member is rotated 45°, wherein at least one anchor pin is pivotally mounted to the pipe joint thereby permitting at least one pipe member to be swung with respect to the pipe joint.

2. The site-assembled folding shelf according to claim 1, wherein each pipe joint comprises:

a base; and a plurality of pipe anchor pins formed integrally with the base to meet at right angles with the base;

wherein each pipe anchor pin has a substantially octagonal cross-section with coupling surfaces for contacting the interior of the pipe member.

3. The site-assembled folding shelf according to claim 2, wherein at least one pipe anchor pin comprises a support member extending integrally from the base and a rotating member rotatably mounted to the support member.

4. The site-assembled folding shelf according to claim 3, wherein the rotating member has a substantially octagonal cross-section and wherein a retaining slot is disposed in the proximal end of the rotating member for receiving and rotatably retaining the support member by means of a screw, or the like.

5. A site-assembled folding shelf suitable for displaying merchandise and configured by assembling pipe members and pipe joints, the shelf comprising:

a plurality of pipe members having a substantially square interior cross-section;

a plurality of pipe joints;

each pipe join comprising a base, a plurality of integrally formed stationary pipe anchor pins extending from the base, and at least one rotating pipe anchor pin;

wherein the rotating anchor pin comprises a support member integrally formed with the base and a rotating member rotatably joined to the support member;

wherein at least one stationary pipe anchor pin and at least one rotating member comprise a column of substantially octagonal cross-section with coupling surfaces for contacting interior walls of the pipe member.

* * * * *